US009039579B1

(12) United States Patent
Osime

(10) Patent No.: US 9,039,579 B1
(45) Date of Patent: May 26, 2015

(54) CONVERTIBLE ACUPRESSURE TREADMILL BELT AND TREADMILL

(71) Applicant: Joshua Osime, Houston, TX (US)

(72) Inventor: Joshua Osime, Houston, TX (US)

( * ) Notice: Subject to any disclaimer, the term of this patent is extended or adjusted under 35 U.S.C. 154(b) by 75 days.

(21) Appl. No.: 13/869,261

(22) Filed: Apr. 24, 2013

Related U.S. Application Data

(60) Provisional application No. 61/637,271, filed on Apr. 24, 2012.

(51) Int. Cl.

| | |
|---|---|
| ***A63B 22/02*** | (2006.01) |
| ***A63B 22/00*** | (2006.01) |
| ***A63B 71/00*** | (2006.01) |
| ***A63B 22/14*** | (2006.01) |

(52) U.S. Cl.
CPC ..... *A63B 22/14* (2013.01)

(58) Field of Classification Search
CPC .... A63B 22/00; A63B 22/02; A63B 22/0235; A63B 22/0242; A63B 22/0257; A63B 22/0285
USPC ..... 482/51, 52, 54
See application file for complete search history.

(56) References Cited

U.S. PATENT DOCUMENTS

| | | | | |
|---|---|---|---|---|
| 3,941,377 | A * | 3/1976 | Lie | 482/70 |
| 4,334,676 | A * | 6/1982 | Schonenberger | 482/54 |
| 4,509,510 | A * | 4/1985 | Hook | 601/28 |
| 4,925,183 | A * | 5/1990 | Kim | 482/61 |
| 5,158,073 | A * | 10/1992 | Bukowski | 601/28 |
| 5,250,067 | A * | 10/1993 | Gelfer et al. | 606/189 |
| 5,470,293 | A * | 11/1995 | Schonenberger | 482/54 |
| 5,527,241 | A * | 6/1996 | Peng | 482/54 |
| 5,690,587 | A * | 11/1997 | Gruenangerl | 482/54 |
| 6,162,150 | A * | 12/2000 | Lee | 482/51 |
| 6,860,836 | B1 * | 3/2005 | Wu | 482/37 |
| 6,918,859 | B1 * | 7/2005 | Yeh | 482/54 |
| 7,195,582 | B2 * | 3/2007 | Wu | 482/37 |
| 7,510,511 | B2 * | 3/2009 | von Detten | 482/54 |
| 7,976,437 | B1 * | 7/2011 | von Detten | 482/54 |
| 2002/0177511 | A1 * | 11/2002 | Jang | 482/146 |
| 2005/0170935 | A1 | 8/2005 | Manser | |
| 2005/0221959 | A1 * | 10/2005 | Yeh | 482/54 |
| 2007/0275827 | A1 * | 11/2007 | Glaser | 482/23 |
| 2008/0176719 | A1 * | 7/2008 | To | 482/54 |
| 2009/0170666 | A1 * | 7/2009 | Chiang | 482/54 |

* cited by examiner

*Primary Examiner* — Stephen Crow
*Assistant Examiner* — Garrett Atkinson

(57) ABSTRACT

A convertible treadmill belt apparatus in which base belt (10) is transformable both into an endless belt with prickly acupressure massaging surface by releasable attachment of at least one acupressure patch (20), and into a regular smooth surfaced treadmill belt, also by releasable attachment of at least one bald treadmill patch (50). Unique patches (20) and (50) can also be assembled to create different sized acupressure mats. These are used for massages in a variety of ways including on the floor, in a chair, and suspended on a wall.

11 Claims, 6 Drawing Sheets

CONVERTIBLE ACUPRESSURE TREADMILL BELT AND TREADMILL

CROSS-REFERENCE TO RELATED APPLICATION

This application claims the benefit of provisional patent application Ser. No. 61/637,271, filed on Apr. 24, 2012 by the present inventor, and is incorporated herein by reference.

STATEMENT REGARDING FEDERALLY SPONSORED RESEARCH OR DEVELOPMENT (IF APPLICABLE)

N/A

REFERENCE TO SEQUENCE LISTING, A TABLE, OR A COMPUTER PROGRAM LISTING COMPACT DISC APPENDIX (IF APPLICABLE)

N/A

BACKGROUND

Acupressure or pressure acupuncture (acupuncture without needles) is well known to have lenitive and curative benefits as well as being an aid to relaxation and wellness. Acupressure practiced on the feet is also known as foot reflexology/massage. Bukowski and Gelfer et al patents both disclose such acupressure massage mats. As a user of different foot massage mats, I found that I had to continuously "march-on-the-spot" atop said mats and could not enjoy the free flow of a natural walking motion.

Treadmills are well known especially for running and walking activities. They usually have an endless belt travelling around a plurality of pulleys, powered by the user's actions or a motor. These "regular" treadmills however offer no acupressure benefits.

U.S. Pat. Nos. 5,527,241, 7,510,511, and 7,976,437 disclose complex specialized treadmills with cobblestone or rounded beads on the outer surface of the treadmill belt.

Amongst other drawbacks, these are not convertible back to "regular" smooth surfaced belts, so a user desiring such would have to purchase another treadmill apparatus.

US patent application publication 20050170935 discloses a proprioceptive exercise mat and a set of specialized whole treadmill belts. For the person that desires to combine bare foot massages with regular running/walking on a smooth surface treadmill, they would have to purchase a combination of different treadmills and /or exercise mats and/or contend with daily complex whole treadmill belt changes.

SUMMARY

In accordance with one or more aspects herein, there is disclosed a treadmill belt convertible to and from a regular smooth running surface from and to a prickly massaging acupressure surface, by simple and quick predetermined steps to be taken by the end user; and a treadmill utilizing said convertible belt powered by a motor or by exertion of person utilizing same.

ADVANTAGES

One or more embodiments herein will show several advantages including that the end user having one exercise device that can be quickly and simply converted to different format in order to perform various tasks, including usage as an acupressure mat amenable to, for example, feet and back acupressure massages; an acupressure treadmill amenable to, for example, feet acupressure massages in conjunction with free flowing and natural leg and hand motion; and a regular smooth surface treadmill used usually for walks and jogs. Another advantage is the relative inexpensiveness of and cost savings associated with the end user procuring one device that replaces at least three other exercise and massage devices.

DRAWING—FIGURES

The drawings are schematic in nature and show different aspects and embodiments.

Figure 5:
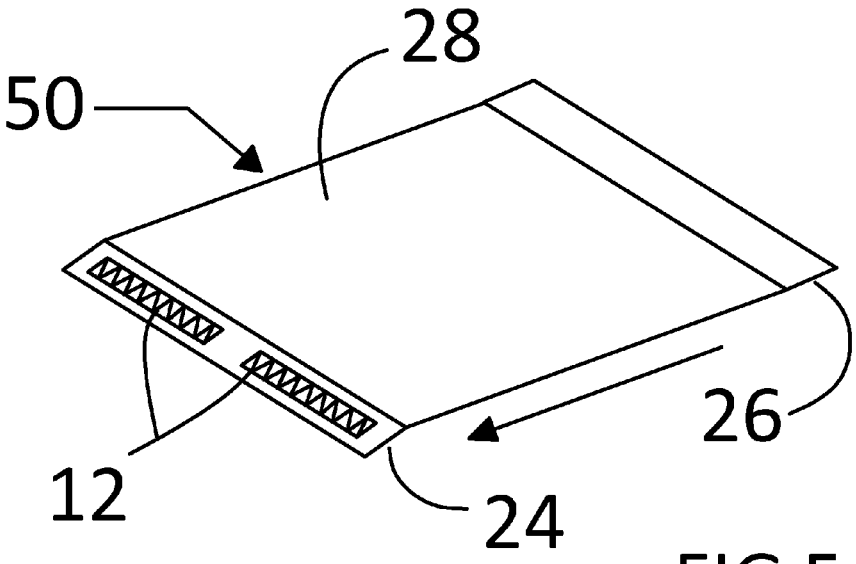
FIG. 5 is a bald treadmill belt patch.
Figure 8:
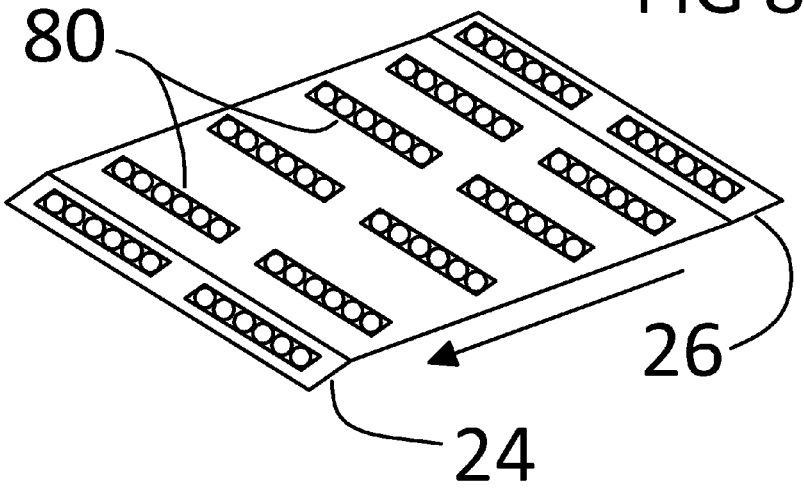

FIG. 8 discloses the identical undersides of both acupressure and bald treadmill belt patches (respectively FIGS. 2 and 5), showing the hooks portion of known loops and hooks recloseable fastener combination.

Figure 9:
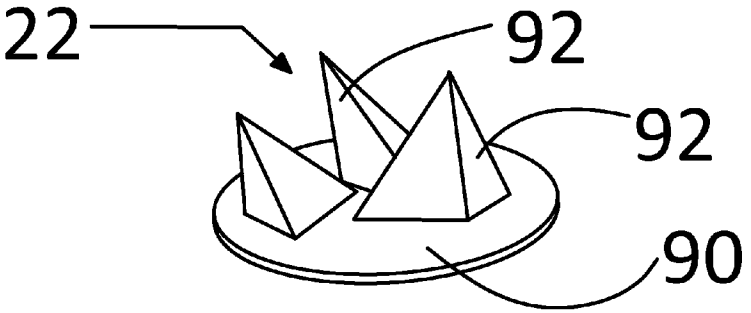

FIG. 9 shows an example of acupressure spikes mentioned herein.

Figure 2:
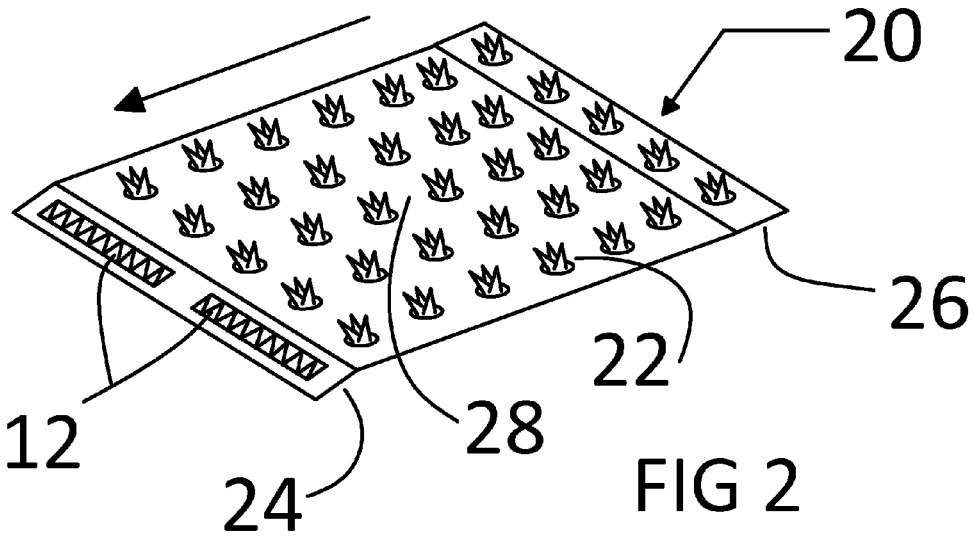
FIG. 2 is an acupressure treadmill belt patch with acupressure spikes.
Figure 10:
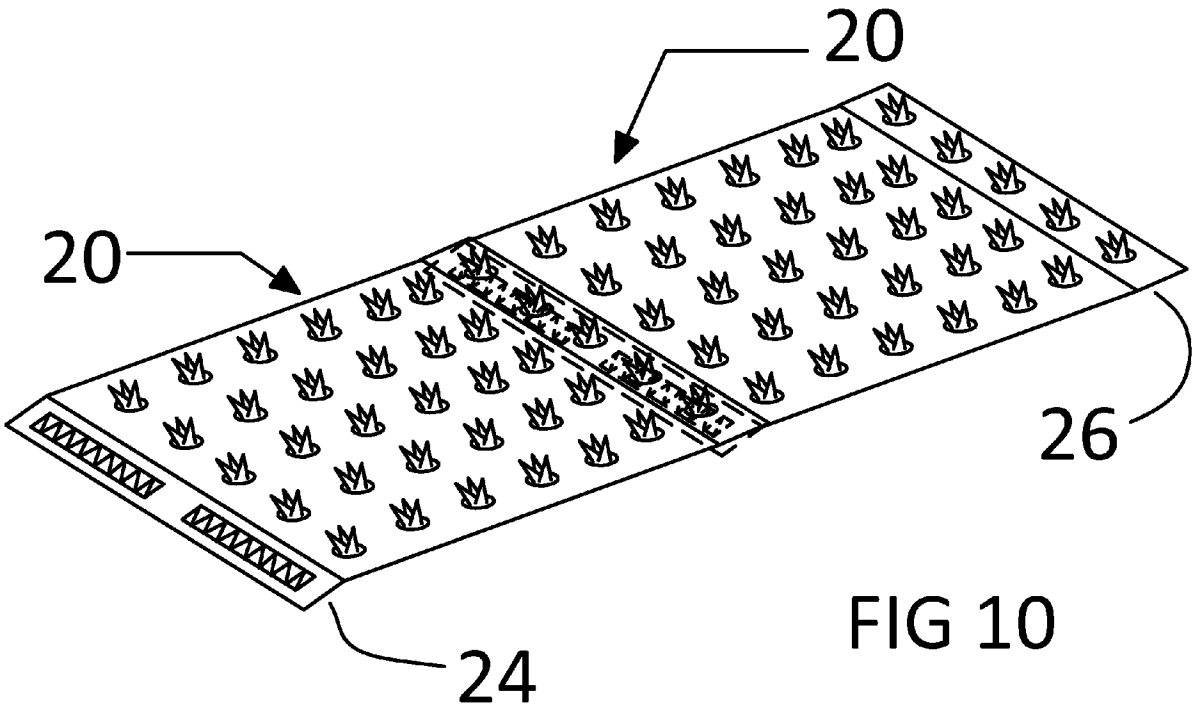

FIG. 10 shows two acupressure treadmill belt patches of FIG. 2 set up together as a floor acupressure mat.

DRAWING—REFERENCE NUMERALS

10 a base treadmill belt having the loops portion of known loops and hooks recloseable fastener combination, on the outer surface of the belt
12 loops of loops and hooks recloseable fastener combination
14 treadmill belt pulley
20 acupressure treadmill belt patch with acupressure spikes
22 acupressure spike cluster
24 patch interconnector lower lip
26 patch interconnector upper lip
28 patch main section
50 bald treadmill belt patch
60 modified base treadmill belt with recloseable fastener loops and acupressure spikes
80 hooks of loops and hooks recloseable fastener combination
90 horizontal base member of spike cluster 22
92 individual spike in spike cluster 22

DETAILED DESCRIPTION

First Embodiment

Figure 1:
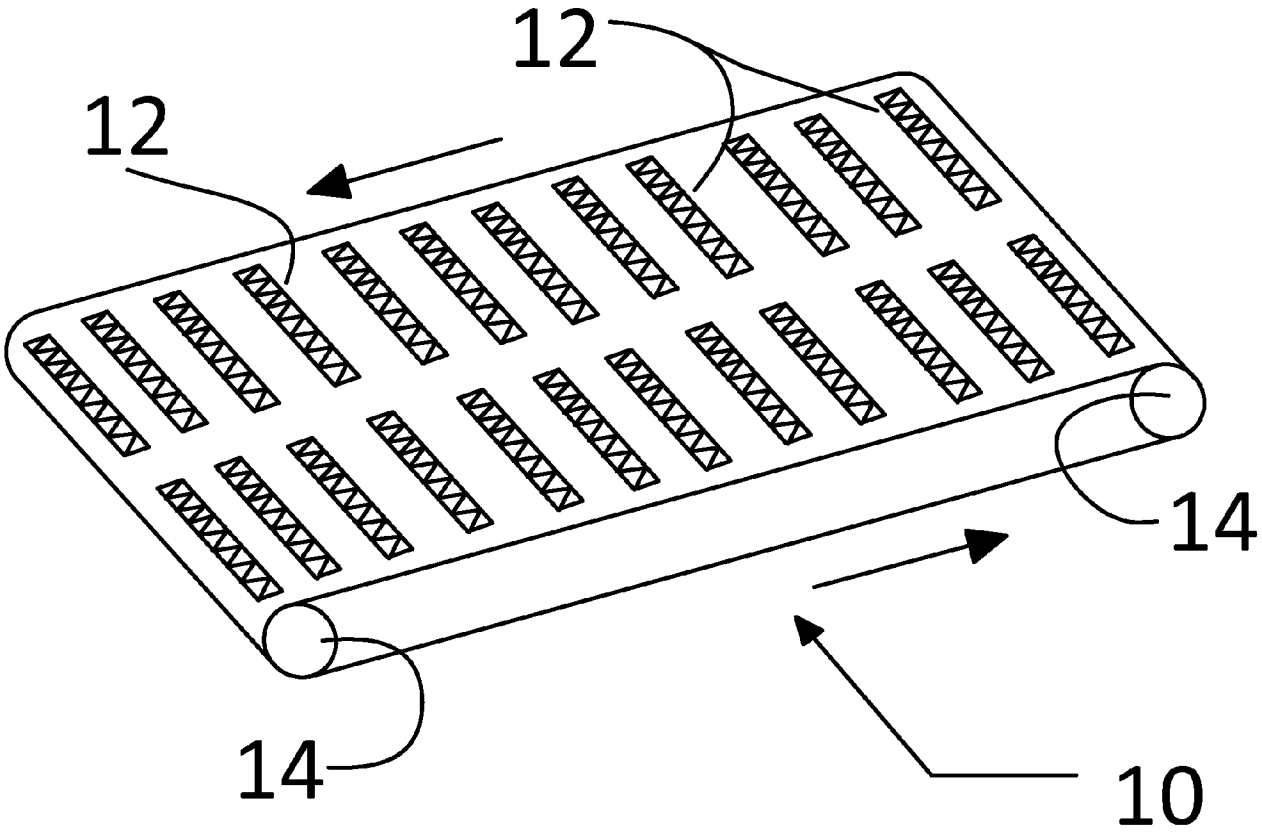
FIG. 1 is a perspective drawing of an embodiment showing a base treadmill belt having the loops portion of known loops and hooks recloseable fastener combination, on the outer surface of the belt.

In one embodiment, the starting point is a base treadmill belt 10 of FIG. 1, having sections of loops 12 of known loops and hooks recloseable fastener combination, on its outer surface. These loops sections 12 may be formed on or affixed to the belt surface by suitable means including but not limited to gluing and sewing.

Figure 6:
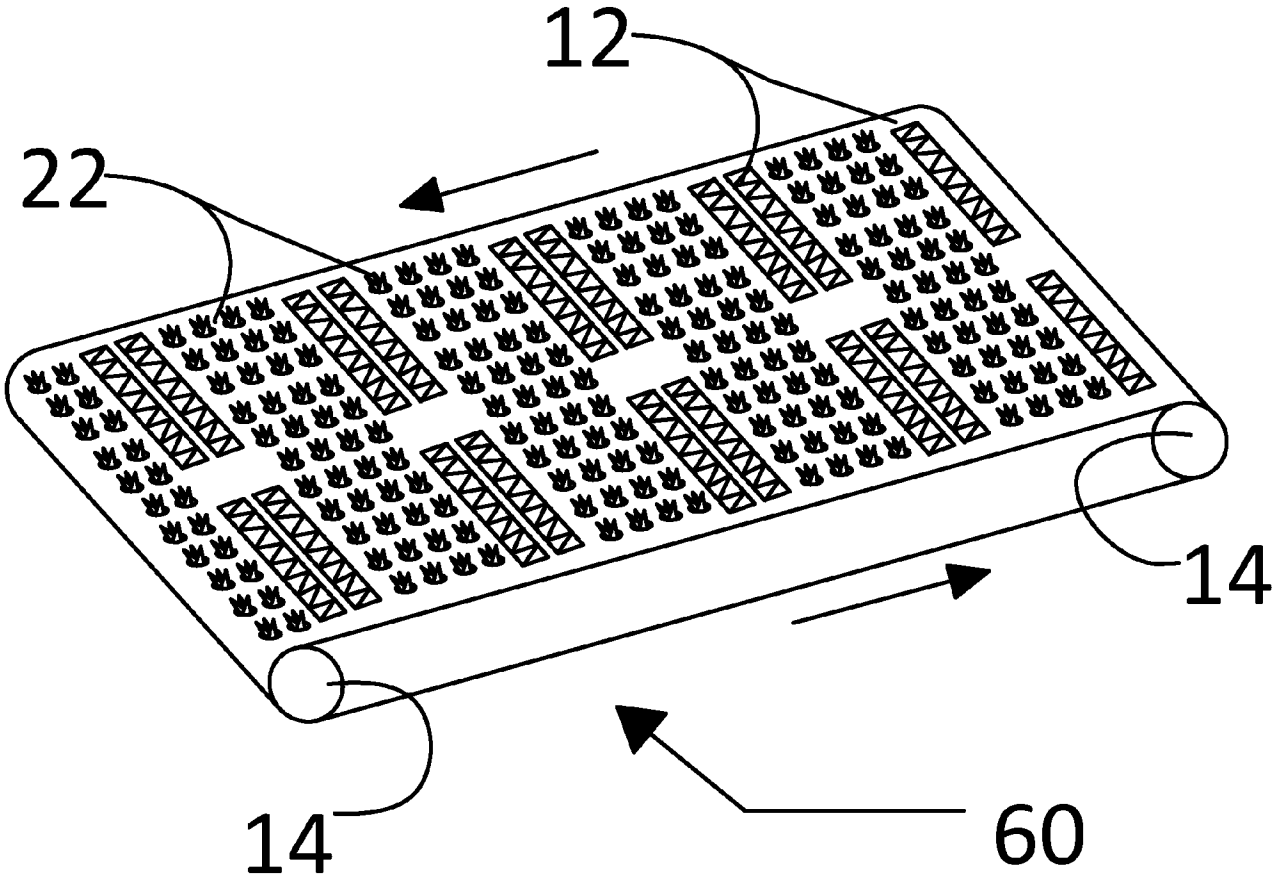
FIG. 6 shows a perspective view of another embodiment with the base treadmill belt having both recloseable fastener loops and acupressure spikes.

FIG. 2 discloses an acupressure treadmill belt patch 20 made from a suitable and durable flexible sheet of material such as a mesh reinforced plastic sheet, of substantially the same width as that of the base treadmill belt 10 of FIG. 1 or modified base treadmill belt 60 of FIG. 6. It could be of any suitable predetermined length so long as the base belts would be completely covered circumferentially as described here and without overage, in using one or more pieces of patch 20. The top side of acupressure patch 20 has three sections: a patch interconnector lower lip section 24, a patch interconnector upper lip section 26, and patch main section 28. The patch upper lip 26 and main section 28 are populated with acupressure spikes 22, which could be of similar or varying degrees of size, tapering, and rigidity. These acupressure spikes 22 could be formed into patch 20 or affixed thereunto by suitable means. The top side of lower lip 24 is covered by the loops 12 of known loops and hooks recloseable fastener combination. Hooks 80 of known loops and hooks recloseable fastener combination cover the underside of all three sections of acupressure patch 20 as shown in FIG. 8.

Figure 3:
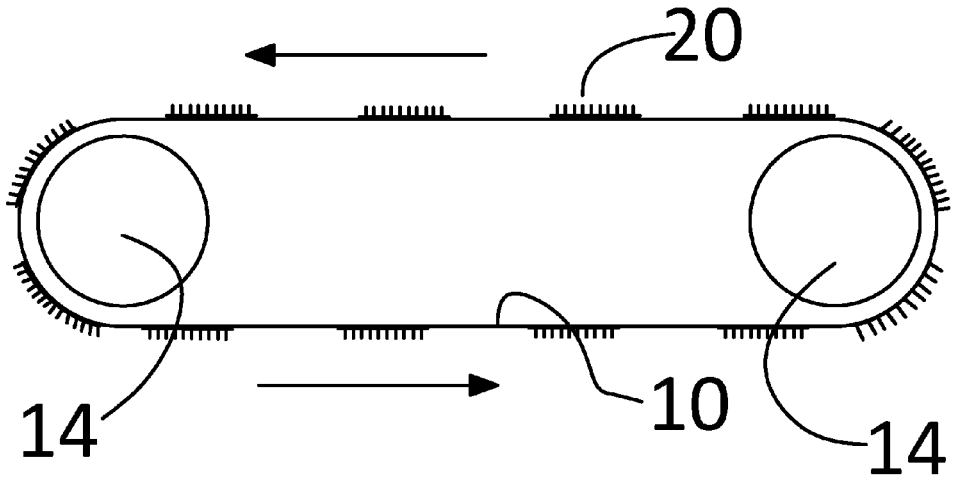
FIG. 3 is a side view of the treadmill belt of FIG. 1 partially covered with acupressure treadmill patches.

To set up the treadmill belt for acupressure massage, the user aligns and releaseably attaches at least one acupressure patch 20 to base treadmill belt 10 (already situated in a treadmill apparatus) using their recloseable fastener combination. Where more than one acupressure patch 20 is used to cover the entire circumferential surface of the base belt 10, the first patch is placed such that the lower lip 24 leads in the direction of rotation of the base belt 10. Thereafter, another patch 20, placed in front of lower lip 24 is so positioned that said later patch 20's upper lip aligns exactly over and is firmly pressed down to attach to prior patch 20's lower lip 24 and so on. This would result in the treadmill belt illustrated in FIG. 4. When total patch 20 coverage is not desired, the user may space out the positioning of the patches 20 as desired, leading to an acupressure belt illustrated in FIG. 3. After desired base belt 10 coverage by patches 20 has been setup, user simply walks atop patches 20 substantially barefooted, the treadmill being motor powered or user propelled, in a free flowing gait.

Figure 7:
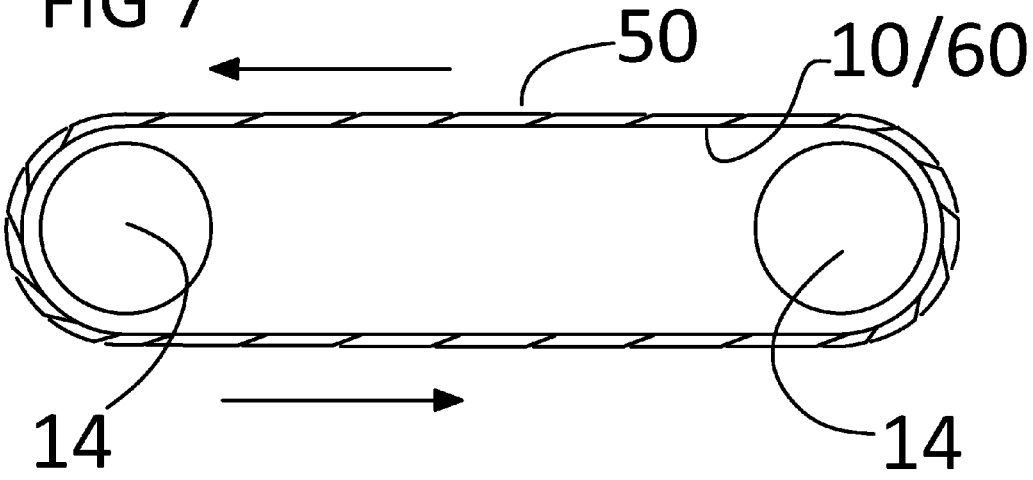
FIG. 7 shows a side view of the treadmill belt of FIG. 1 or FIG. 6 fully covered with overlapping bald treadmill patches.

In reconfiguring the treadmill belt above for regular walking or running, the user simply detaches the acupressure patches 20 and said base belt 10 is usable as is for that purpose. Where greater surface smoothness is required however, and to cover releasable attachment means used, upon detaching the acupressure patches 20, the user replaces them with at least one bald treadmill patch 50, in the same manner described above. The resultant smoother surfaced treadmill belt is illustrated in FIG. 7. The bald patch 50 is similar in all respects to the acupressure patch 20 in features and mode of operation except for the absence on its top surface of acupressure spikes 22.

FIG. 9 shows an example of an acupressure spike cluster 22, having a horizontal base member 90 from which spikes 92 sprout. It could be made of plastic or other suitable material.

Second Embodiment

Figure 4:
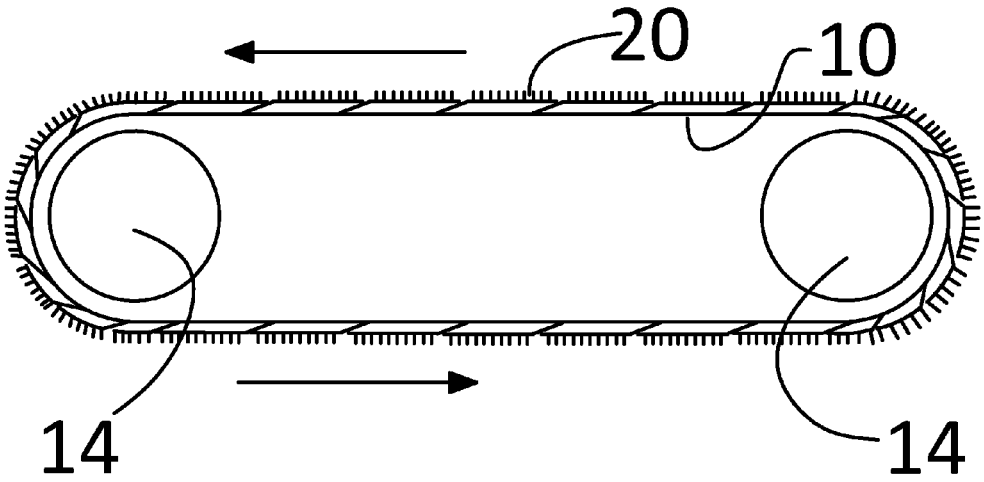
FIG. 4 is a side view of the base treadmill belt of FIG. 1 fully covered with overlapping acupressure treadmill patches.

In another embodiment, the outer surface of the modified base treadmill belt 60 is populated with acupressure spikes 22 interlaced with loops 12 of loops and hooks recloseable fastener combination as illustrated in FIG. 6. The spikes 22 and loops 12 are attached to the base belt 60 by suitable means, including sewing and gluing, and may also be formed into the base belt 60. The user has the options of using base belt 60 as is, set up in a treadmill apparatus, for acupressure massage, or may releaseably affix acupressure patches 20, in the manner described above, to make base belt 60 more or completely covered, as illustrated by FIG. 4. The user may also convert base belt 60 to a smooth running surface belt by attaching bald treadmill patches 50, also as previously set forth herein. The operation of this embodiment is similar to the first above, except in the particular differences outlined here.

Third Embodiment

In another embodiment, at least one acupressure patch 20 and/or bald patch 50 are combined together, using their recloseable lower 24 and upper 26 lips to form free standing, non-treadmill, acupressure mats. FIG. 10 show an acupressure mat formed from two acupressure patches 20. The interconnector upper lip 26 of one patch 20 is placed over and aligned with the interconnector lower lip 24 of another patch 20 and pressed firmly to form a recloseable bond. Resultant mat could be used in a variety of ways, including but not limited to, as a mat for other kinds of floor exercises combinable with an acupressure workout or laid over a seat or bed or suspended on a wall to that user can position desired body part such as the back, to contact the massage spikes 22.

CONCLUSIONS, RAMIFICATIONS AND SCOPE

The reader can see from the foregoing that at least one or more embodiments provides a single device that a user can modify and adapt at least for regular walking and jogging on an endless belt; for reflexology massages; combined reflexology and walking/jogging exercises; acupressure mats furnishing platforms for combining acupressure with other amenable exercises; and so forth.

Although the description above contains many specifics, they should not be construed as limiting the scope of the embodiments but as merely providing illustrations of some of the several embodiments. For example, other suitable releasable attachment means may be utilized in place of loops and hooks of known loops and hooks recloseable fastener combination such as snap buttons, zippers, and buckles. In addition, the embodiment parts to which releasable attachment combination constituents are attached may be interchanged.

Accordingly, the scope should not be determined by the embodiments illustrated but by the appended claims and their legal equivalents.

The invention claimed is:

1. An exercise equipment, comprising:

a. a treadmill apparatus with a base treadmill belt traveling around a pulley having releasable attachment means on an outer surface for receiving at least one suitably dimensioned flexible sheet of material or patch, b. said at least one suitably dimensioned flexible sheet of material or patch, having complementary releasable attachment means underneath and a smooth and/or prickly top surface, whereby upon releasable attachment of at least one said suitably dimensioned flexible sheet or patch, said treadmill belt's surface is transformed to and from a regular smooth running surface to a partial or full prickly surface.

2. The exercise equipment of apparatus of claim 1 wherein said patches are made of mesh reinforced plastic.

3. The exercise equipment of claim 1 wherein said prickly surfaced patches have varied spikes formed in or attached to their upper surface.

4. The exercise equipment of claim 1 wherein said releasable attachment means is loops and hooks recloseable fastener combination.

5. The exercise equipment of claim 1 wherein said releasable attachment means is a zip recloseable fastener combination.

6. The exercise equipment of claim 1 wherein said releasable attachment means is a snap button recloseable fastener combination.

7. The exercise equipment of claim 1 wherein said patches have the same releasable attachment means situate on said base treadmill belt replicated on the fore portion of said patch's top surface, said fore portion leading in the direction of travel of said base treadmill belt.

8. The exercise equipment of claim 7 wherein a smooth and/or prickly surface is created by releaseably and overlappingly attaching the necessary patches to said base treadmill belt such that said fore portion of patches top surface receive atop of each, substantially equivalent stern portions of another patch, the stern being the trailing portion of the patch when moving in the direction of travel of the base treadmill belt.

9. The exercise equipment of claim 8, wherein said patches are overlappingly and releaseably attached to form an exercise mat for use without attachment to said treadmill belt.

10. The exercise equipment of claim 1 wherein varied spikes are formed in or attached to said base treadmill belt outer surface and interlaced with said releasable attachment means.

11. A method of reversibly changing the surface texture of a treadmill belt, comprising a. providing a base treadmill belt travelling around a pulley and having releasable attachment means on an outer surface for receiving at least one suitably dimensioned flexible sheet of material or patch, b. providing said at least one suitably dimensioned flexible sheet of material or patch, having complementary releasable attachment means underneath and a smooth and/or prickly top surface, c. reversibly changing the surface texture of said base treadmill belt by releaseably attaching said suitably dimensioned flexible sheets onto said base treadmill belt, whereby upon releasable attachment of at least one said suitably dimensioned flexible sheet or patch, said treadmill belt's surface is transformed to and from a regular smooth running surface to a partial or full prickly surface.

* * * * *